US006776501B2

(12) United States Patent
Burnidge

(10) Patent No.: US 6,776,501 B2
(45) Date of Patent: Aug. 17, 2004

(54) ILLUMINATING HANDLE/STRAP

(76) Inventor: Lane E. Burnidge, 5N916 Sunset St., Maple Park, IL (US) 60151

( * ) Notice: Subject to any disclaimer, the term of this patent is extended or adjusted under 35 U.S.C. 154(b) by 0 days.

(21) Appl. No.: 09/974,304

(22) Filed: Oct. 10, 2001

(65) Prior Publication Data

US 2003/0067766 A1 Apr. 10, 2003

(51) Int. Cl.[7] ..... A45C 15/06
(52) U.S. Cl. ..... 362/156; 362/108; 362/103
(58) Field of Search ..... 362/102, 103, 362/108, 800, 240, 101, 154, 155, 156

(56) References Cited

U.S. PATENT DOCUMENTS 2,644,882 A 7/1953 Voda
4,523,258 A * 6/1985 Morse et al. ..... 362/108
5,008,595 A * 4/1991 Kazar ..... 315/178
5,052,131 A * 10/1991 Rondini ..... 36/11.5
5,475,574 A * 12/1995 Chien ..... 362/108
5,535,106 A * 7/1996 Tangen ..... 362/108
5,547,190 A * 8/1996 Mackewich et al. ..... 463/47.4
5,607,226 A * 3/1997 Toth et al. ..... 362/102
5,913,671 A 6/1999 Fernandez
6,135,621 A 10/2000 Bach et al.
2002/0116791 A1 * 8/2002 Grady et al. ..... 16/444

* cited by examiner

*Primary Examiner*—Thomas M. Sember
*Assistant Examiner*—Hargobind S. Sawhney

(57) ABSTRACT

An electrically powered illuminating handle/strap for lifting, pulling, carrying, opening, holding or whatever. The light source is the handle/strap. Illumination can occur in different ways by aiming the light emitting means. Directions can be: generally, as in all directions; partially, such as drown into a container, at what it is attached to, or towards the person using it; specifically, such as at signage or a keyhole on or adjacent to what it is attached to; or in a combination of several directions at once. Different or combinations of light emitting means can be used. The handle can be rigid or flexible. This is a simple cost effective way to increase visibility and safety.

16 Claims, 2 Drawing Sheets

ILLUMINATING HANDLE/STRAP

BACKGROUND OF THE INVENTION

1. Field of the Invention

This invention is a handle, specifically an improved way to illuminate the handle its surroundings and what it is attached to.

2. Description of Prior Art

Not being able to see something or being seen by others carrying something has been a problem since God separated night and day. Others have partially solved the problem. U.S. Pat. No. 6,135,621 is aback lit grab bar. U.S. Pat. No. 5,913,671 are fishing implements with illuminating inserts and U.S. Pat. No. 2,644,882 is a handle illuminating the inside of a refrigerator. All solve their problem. None can be flexible or rigid and none illuminate the inside or outside of what they are attached to. In addition ours, using lamps and reflectors or light emitting diodes placed on or in or as the handle, can aim light. This is very useful for illuminating trick or treat carriers, medical equipment, inside purses, or doors with signage and key holes.

BRIEF SUMMARY OF INVENTION

The object of the present invention is to provide an improved illuminating handle, flexible or rigid, electricity powered, where the light source is the handle. This handle is highly visible, and can direct light at a target or what it is attached to or its surroundings

BRIEF DESCRIPTION OFF THE DRAWINGS

The accompanying drawings, which are incorporated into and constitute part of this specification, illustrate a preferred embodiment of the invention, and together with the detailed description below, serve to explain the invention in greater detail.

DETAILED DESCRIPTION OF THE INVENTION

The following description is provided to enable one skilled in the art to make and use the invention and sets forth the best mode of the invention. Variations of the invention will be readily apparent to those skilled in the art.

Figure 1:
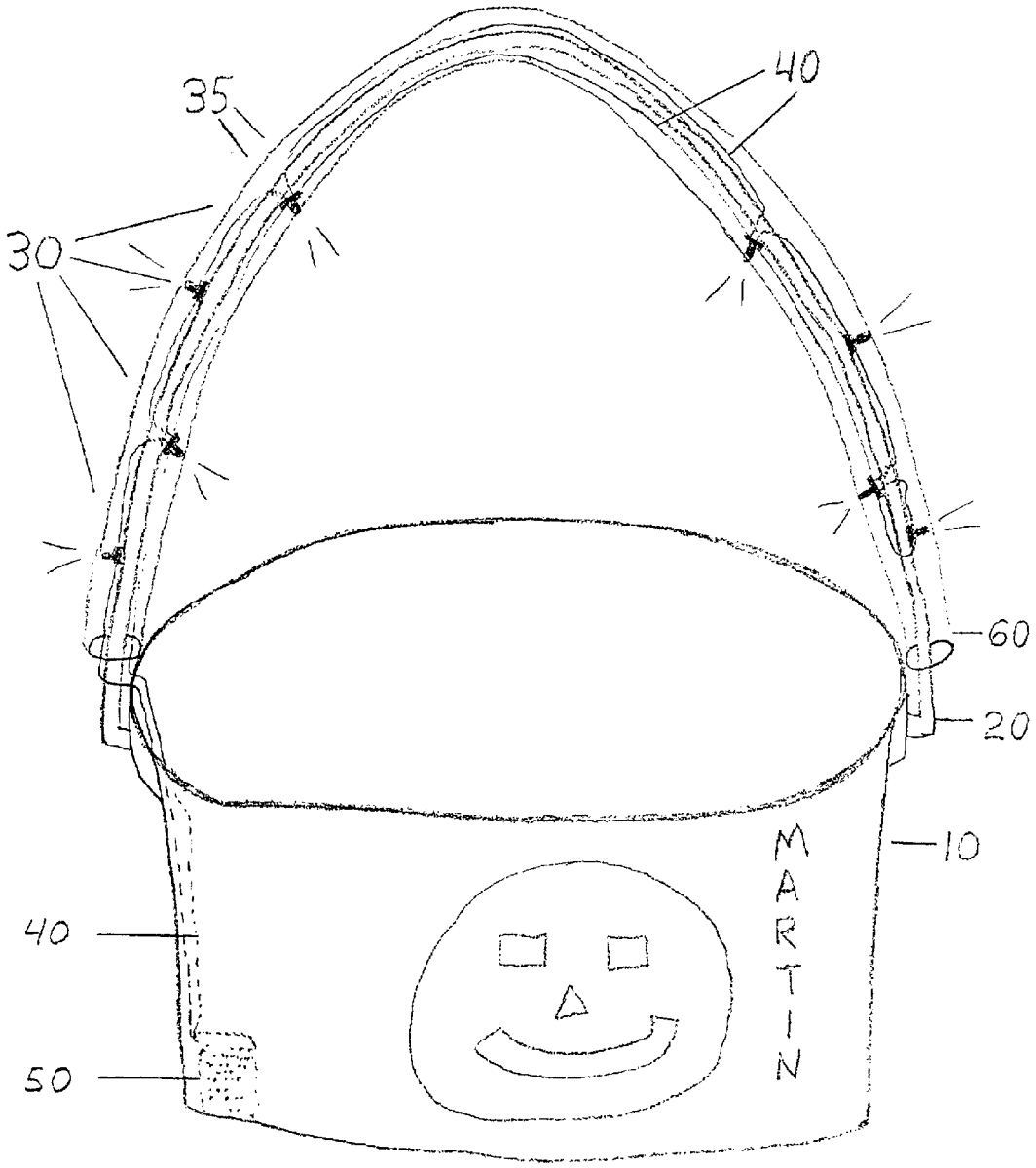
FIG. 1 is the illuminating handle with lights shining into and illuminating away from the container making it quite visible.

FIG. 1 shows a view of a container 10 with its original strap handle 20, holes have been punched though the strap to hold the lamps 30. (Light Emitting Diodes) in place lead wires 35 on the lamps are bent to aim the light. The amps 30 are connected as needed (series/parallel) by wires 40 to the batter 50. A clear tube 60 encases the handle 20 with its lights 30 and wires 40 inside. The battery rests inside the container 10.

Figure 2:
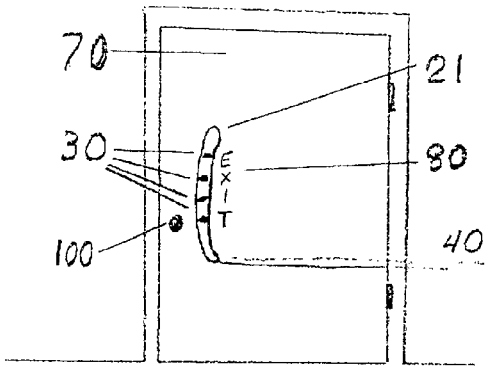
FIG. 2 is a door within a rigid illuminated handle shining on an exit sign making the handle and keyhole visible.

FIG. 2 shows a door 70 with lights 30 aimed at signage 80, and key hole 100 wires 40 are connected to main power supply. Handle 21 is a rigid clear tube.

Figure 3:
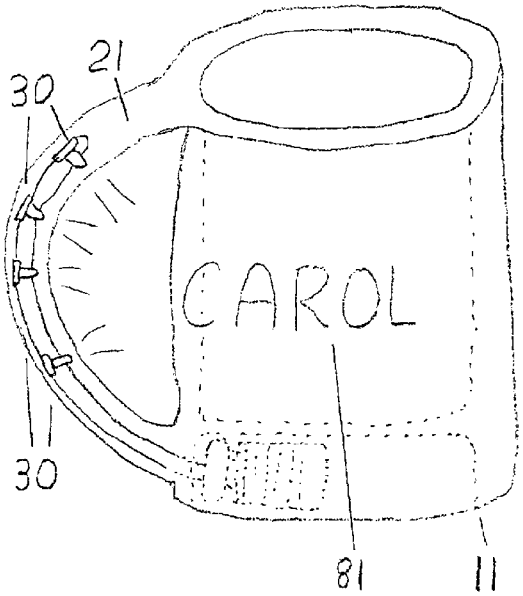
FIG. 3 is a mug with light shining from within the handle onto a name printed on the mug.

FIG. 3 shows a container 11 with handle 21, lights 30 aimed at signage 81.

Figure 4:
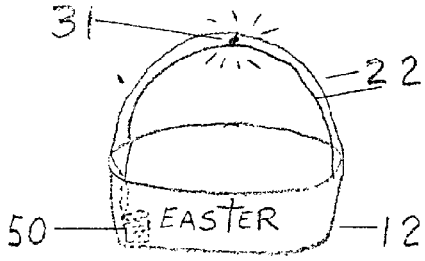
FIG. 4 is a simple basket with a handle, rigid or flexible, made of two conductors with a light wired between them, illuminating the basket and its surroundings.
Figure 5:
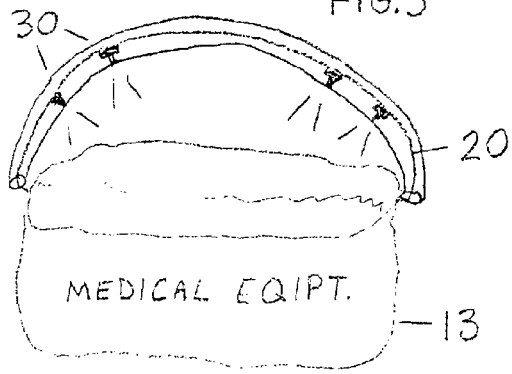
FIG. 5 is a cloth bag and lighted handle with the bulk of light shining onto the top and when opened, onto the contents inside.

FIG. 4 shows a container 12 where the two handle straps 22 are also conductors connected to a battery 50. Lamp 31 is connected between the handle straps and illuminates the container 12 and its surroundings FIG. 5 shows a flexible handle 20 with lights 30 illuminating a cloth bag 13

Figure 6:
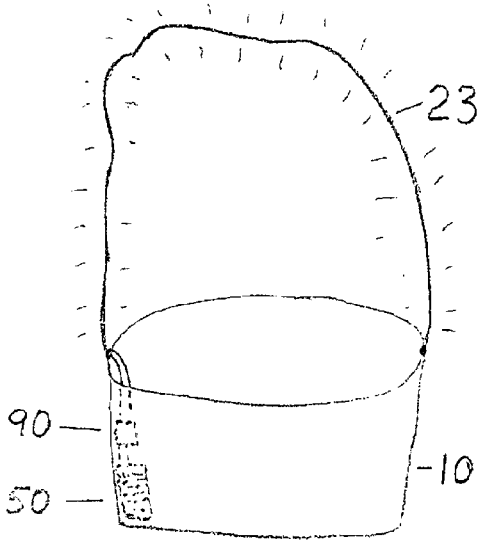
FIG. 6 is a container using only flexible electroluminescent material for a handle Battery aid controller are inside.

FIG. 6 shows strap 23 made of electroluminescent material illuminating the container 10 and its surroundings, battery 50 and its controller 90 are inside.

The preferred embodiment of FIG. 1 uses a 9V battery connected to four light emitting diodes in series aimed at the container and four light emitting diodes in series aimed away from the container.

While the above drawings describe the illuminating handle/shoulder strap, other variations are contemplated within its scope. Those include other handles, how to connect them, one or more flashing lights, incandescent bulbs with and without reflectors, surface mount light emitting diodes, photo switches, pull switches, motion and other types. Also other means to securing the lights, battery placement or separate holder in handle or container. Other variations using electroluminescent materials or hard wiring to utility grid, ways to secure the handle/strap in a specific orientation are also being considered.

The various aspects of the invention provide a novel concept. For a simple, inexpensive illuminating handle/shoulder strap for improving the safety of children trick, or treating and others in their night activities.

While the present invention has been illustrated by the description of the preferred embodiments, it is not the intention of the applicant to in any way limit the scope of the appended claims. Additional modifications and advantages will be readily apparent to one skilled in the art. Therefore, the invention's scope is not to be limited to the specific described embodiments.

What is claimed:

1. An illuminating handle for a container comprising:

a handle;

one or more light emitting diodes placed laterally along said handle;

a battery receptacle adapted to receive at least one battery;

wire connecting said light emitting diodes in series to said battery receptacle, at least one of the light emitting diodes is continually directed toward the container such that the at least one of the light emitting diodes illuminates the container when said at least one of the light emitting diodes is emitting light; and a tube encasing said rigid handle, light emitting diodes, and wire.

2. The illuminating handle of claim 1 wherein the one or more light emitting diodes is continually directed toward an interior of the object.

3. The illuminating handle of claim 2 wherein the object is a translucent trick or treat carrier.

4. The illuminating handle of claim 1 wherein at least one light emitting diode is continually directed away from the object.

5. The illuminating handle of claim 1 wherein at least one of said light emitting diodes is flashing.

6. An illuminating handle comprising:

a handle attachable to an object;

one or more light emitting diodes placed laterally along said handle wherein at least one light emitting diode is continually directed toward the object to which said handle is attached such that at least one light emitting diode is illuminating the object when the at least one light emitting diode is emitting light;

an electrical connection for receiving an electricity source;

a circuit means connecting said light emitting diodes to said electrical connection; and a tube encasing said handle, light emitting diodes, and circuit means.

7. The illuminating handle of claim 6 wherein the circuit means is one of a parallel wired circuit and a series wired circuit.

8. The illuminating handle of claim 6 wherein said electricity source is at least one battery.

9. The illuminating handle of claim 6 wherein the object is a trick or treat carrier and the at least one light emitting diode comprises a plurality of light emitting diodes continually directed toward the trick or treat carrier such that the interior of the trick or treat carrier is illuminated.

10. The illuminating handle of claim 9 wherein the trick or treat carrier is translucent.

11. The illuminating handle of claim 9 wherein the electrical connection is located inside the trick or treat carrier.

12. The illuminating handle of claim 9 wherein said electricity source is a nine volt battery.

13. The illuminating handle of claim 9 wherein at least one of the one or more light emitting diodes is continually directed away from the interior of the trick or treat carrier.

14. The illuminating handle of claim 9 wherein said electricity source is at least one battery.

15. The illuminating handle of claim 6 wherein the circuit means is a printed circuit board.

16. The illuminating handle of claim 6 wherein at least one end of the tube forms an end cap.

* * * * *

UNITED STATES PATENT AND TRADEMARK OFFICE

CERTIFICATE OF CORRECTION

PATENT NO. : 6,776,501 B2
DATED : August 17, 2004
INVENTOR(S) : Lane E. Burnidge It is certified that error appears in the above-identified patent and that said Letters Patent is hereby corrected as shown below:

Column 2,
Line 58, change "said rigid handle" to -- said handle --.

Signed and Sealed this

Thirtieth Day of November, 2004

JON W. DUDAS
*Director of the United States Patent and Trademark Office*